US010041284B2

(12) United States Patent
Yamamoto et al.

(10) Patent No.: US 10,041,284 B2
(45) Date of Patent: Aug. 7, 2018

(54) WINDOW REGULATOR

(71) Applicant: SHIROKI CORPORATION, Fujisawa-shi, Kanagawa (JP)

(72) Inventors: Kenji Yamamoto, Fujisawa (JP); Yoshiki Tanabe, Fujisawa (JP)

(73) Assignee: SHIROKI CORPORATION, Fujisawa-Shi, Kanagawa (JP)

( * ) Notice: Subject to any disclaimer, the term of this patent is extended or adjusted under 35 U.S.C. 154(b) by 0 days.

(21) Appl. No.: 15/540,147

(22) PCT Filed: Apr. 22, 2016

(86) PCT No.: PCT/JP2016/062818
§ 371 (c)(1),
(2) Date: Jun. 27, 2017

(87) PCT Pub. No.: WO2016/171267
PCT Pub. Date: Oct. 27, 2016

(65) Prior Publication Data

US 2018/0010379 A1 Jan. 11, 2018

(30) Foreign Application Priority Data

Apr. 23, 2015 (JP) ..... 2015-088719

(51) Int. Cl.
*E05F 11/48* (2006.01)
*E05F 11/38* (2006.01)
*E05F 15/689* (2015.01)

(52) U.S. Cl.
CPC ..... *E05F 11/483* (2013.01); *E05F 11/385* (2013.01); *E05F 15/689* (2015.01)

(58) Field of Classification Search
CPC ..... E05F 11/483; E05F 11/385; E05F 15/689
(Continued)

(56) References Cited

U.S. PATENT DOCUMENTS 4,637,166 A * 1/1987 Ujihara ..... E05F 11/485 49/352
5,505,022 A * 4/1996 Shibata ..... E05F 11/481 49/349

(Continued)

FOREIGN PATENT DOCUMENTS

CN 203879182 U 10/2014
DE 102011056222 A1 * 6/2013 ..... E05F 11/481

(Continued)

OTHER PUBLICATIONS

International Search Report (PCT/ISA/210) dated Aug. 2, 2016, by the Japanese Patent Office as the International Searching Authority for International Application No. PCT/JP2016/062818.

(Continued)

*Primary Examiner* — Jerry E Redman
(74) *Attorney, Agent, or Firm* — Buchanan Ingersoll & Rooney PC

(57) ABSTRACT

In a window regulator which moves a slider base, slidable along a guide rail, via a pair of wires, the slider base includes: a guide portion which is fitted to the guide rail to be movable in the longitudinal direction thereof; first and second wire engaging portions with which ends of the wires are engaged, respectively; and first and second force application portions which receive a force in a moving direction of the slider base from the wires, and the guide portion is positioned in at least one of the areas between the first force application portion and the first wire engaging portion and between the second force application portion and the second wire engaging portion in the widthwise direction of the guide rail. This makes it possible to obtain a window regulator which is superior in smoothness of operation and operating efficiency of the slider base.

5 Claims, 11 Drawing Sheets

(58) Field of Classification Search
USPC ..... 49/352
See application file for complete search history.

(56) References Cited

U.S. PATENT DOCUMENTS

| | | | | |
|---|---|---|---|---|
| 5,528,861 | A * | 6/1996 | Beyerlein | E05F 11/485 49/349 |
| 5,864,987 | A | 2/1999 | Mariel et al. | |
| 5,924,245 | A * | 7/1999 | Manuel | B60J 5/0416 49/352 |
| 6,088,965 | A * | 7/2000 | Fukumoto | E05F 11/486 49/352 |
| 7,765,739 | B2 * | 8/2010 | Munezane | E05F 11/483 49/349 |
| 8,001,726 | B2 * | 8/2011 | Fassbender | E05F 11/382 49/352 |
| 8,099,905 | B2 * | 1/2012 | Sasaki | E05F 11/483 49/352 |
| 8,943,750 | B2 * | 2/2015 | Twork, Jr. | E05F 11/385 49/352 |
| 2002/0139052 | A1 * | 10/2002 | Messiez | B60J 1/17 49/375 |
| 2005/0016071 | A1 * | 1/2005 | Takeda | B60J 5/0416 49/352 |
| 2007/0180773 | A1 * | 8/2007 | Fortin | E05F 11/485 49/352 |
| 2007/0251148 | A1 * | 11/2007 | Watson | E05F 11/485 49/352 |
| 2008/0236049 | A1 * | 10/2008 | Arimoto | E05F 11/382 49/352 |
| 2009/0007494 | A1 * | 1/2009 | Pavlovic | E05F 11/382 49/349 |
| 2009/0007495 | A1 * | 1/2009 | Smith | E05F 11/385 49/352 |
| 2009/0064590 | A1 | 3/2009 | Sasaki et al. | |
| 2010/0031576 | A1 | 2/2010 | Sasaki et al. | |
| 2010/0223852 | A1 | 9/2010 | Arimoto et al. | |
| 2016/0047411 | A1 * | 2/2016 | Simonneau | F16C 1/265 49/352 |
| 2017/0284145 | A1 * | 10/2017 | Suzuki | E05F 15/689 |
| 2017/0292312 | A1 * | 10/2017 | Yokoyama | E05F 15/689 |
| 2017/0370145 | A1 * | 12/2017 | Koike | E05F 15/689 |

FOREIGN PATENT DOCUMENTS

| | | | |
|---|---|---|---|
| EP | 607588 | A1 * | 12/1993 |
| JP | S62-225677 | A | 10/1987 |
| JP | 02272186 | A * | 6/1990 |
| JP | 05280248 | A * | 10/1993 |
| JP | H08-105269 | A | 4/1996 |
| JP | H09-032413 | A | 2/1997 |
| JP | H09-112125 | A | 4/1997 |
| JP | 2001-82027 | A | 3/2001 |
| JP | 2002-322865 | A | 11/2002 |
| JP | 2003-336439 | A | 11/2003 |
| JP | 2005-307529 | A | 11/2005 |
| JP | 2012-057376 | A | 3/2012 |
| JP | 5638886 | B2 | 10/2014 |
| WO | 97/37099 | A2 | 10/1997 |

OTHER PUBLICATIONS

Written Opinion (PCT/ISA/237) dated Aug. 2, 2016, by the Japanese Patent Office as the International Searching Authority for International Application No. PCT/JP2016/062818.

Office Action dated Nov. 28, 2017, by the State Intellectual Property Office (SIPO) of the People's Republic of China in corresponding Chinese Patent Application No. 201680004695.8. (7 pages).

* cited by examiner

WINDOW REGULATOR

TECHNICAL FIELD

The present invention relates to a window regulator which moves a window glass of a vehicle up and down.

BACKGROUND ART

Window regulators which support a slider base, to which a window glass is fixed, in a manner to allow the slider base in the longitudinal direction of a guide rail and which make the window glass move up and down by pulling wires are widely used in vehicles. The slider base has guide portions which are slidably engaged with the guide rail. A pair of wires are routed along the guide rail to pull the slider base in the forward and reverse directions, and ends of the wires are respectively engaged with wire engaging portions provided on the slider base. Pulling the wires causes a force in the raising/lowering direction to act on a force application portion on the slider base to move the slider base.

Patent Literature 1

Japanese Unexamined Patent Publication No. 2001-82027

SUMMARY OF INVENTION

Technical Problem

The slider base of the window regulator disclosed in Patent Literature 1 is configured such that the wire engaging portions are positioned between the force application portion and the guide portions in the widthwise direction of the guide rail. This configuration causes an increase in the distance between the force application portion and the guide portions, so that the turning moment which acts on the slider base about the force application portion tends to be great when the slider base is pulled by each wire. In that case, the guide portions become likely to wear in the slider base, and there is a possibility of the load on movement of the slider base increasing to thereby decrease the operating efficiency of the window regulator.

The present invention has been made in view of the above described issues, and it is an object of the present invention to provide a window regulator which is superior in smoothness of operation and operating efficiency.

Solution to Problem

In a window regulator including: a guide rail which is fixed to a vehicle; a slider base which supports a window glass and is supported on the guide rail to be slidable in the longitudinal direction of the guide rail; and a pair of wires which are routed along the longitudinal direction of the guide rail and connected to the slider base, the present invention has the following features. The slider base includes: a guide portion the movement of which with respect to the guide rail in the widthwise direction of the guide rail is restricted and which is fitted to the guide rail to be movable in the longitudinal direction of the guide rail; first and second wire engaging portions with which ends of the wires are engaged, respectively; and first and second force application portions which receive a force to move the slider base in a pulling direction following contact of the wires with the first and second force application portions when the wires are pulled in the longitudinal direction of the guide rail, wherein the guide portion is positioned in at least one of the areas between the first force application portion and the first wire engaging portion and between the second force application portion and the second wire engaging portion in the widthwise direction of the guide rail.

More desirably, it is advisable that the guide portion be positioned in between the first force application portion and the first wire engaging portion and between the second force application portion and the second wire engaging portion in the widthwise direction of the guide rail.

The slider base can be provided with a plurality of guide portions arranged at different positions in the longitudinal direction of the guide rail. In this case, it is desirable that the first wire engaging portion and the second wire engaging portion be positioned between the plurality of guide portions in the longitudinal direction of the guide rail. In addition, it is desirable that the first force application portion and the second force application portion be positioned between the plurality of guide portions in the longitudinal direction of the guide rail.

It is desirable that the slider base be provided with a wire retaining portion which prevents the ends of the wires from being disengaged from the first wire engaging portion and the second wire engaging portion.

Advantageous Effects of the Invention

According to the prevent invention described above, the arrangement in which the guide portion, which is guided by the guide rail, is positioned between the force application portions, which receive a force to move the force application portions in the pulling direction from the wires, and the wire engaging portions, with which ends of the wires are engaged, suppresses the moment of rotation which acts on the slider base when the window glass is moved up and down, thus making it possible to obtain a window regulator which is superior in smoothness of operation and operating efficiency.

DESCRIPTION OF EMBODIMENTS

Figure 1:
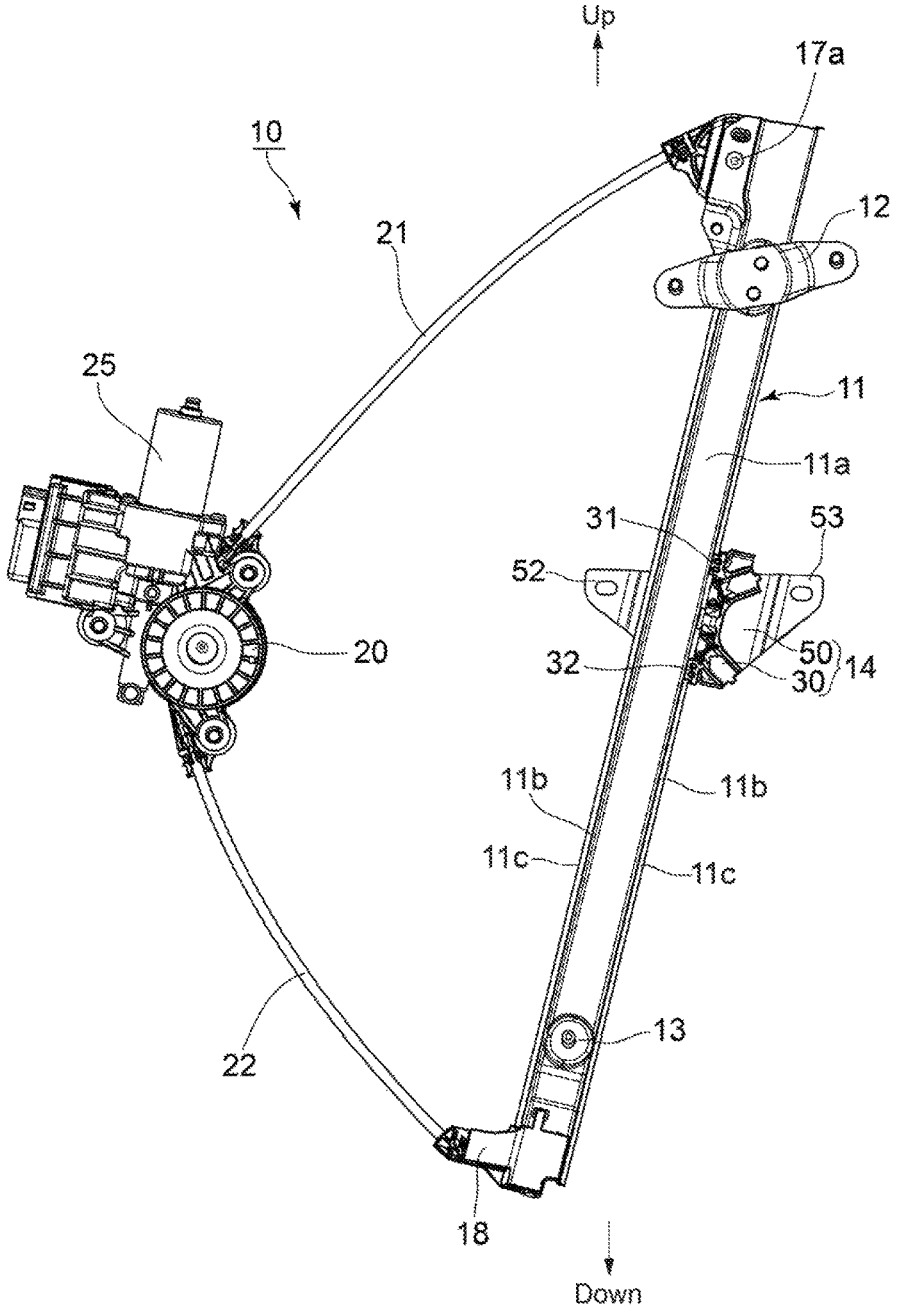
FIG. 1 is a front elevational view of a window regulator according to the present invention.
Figure 2:
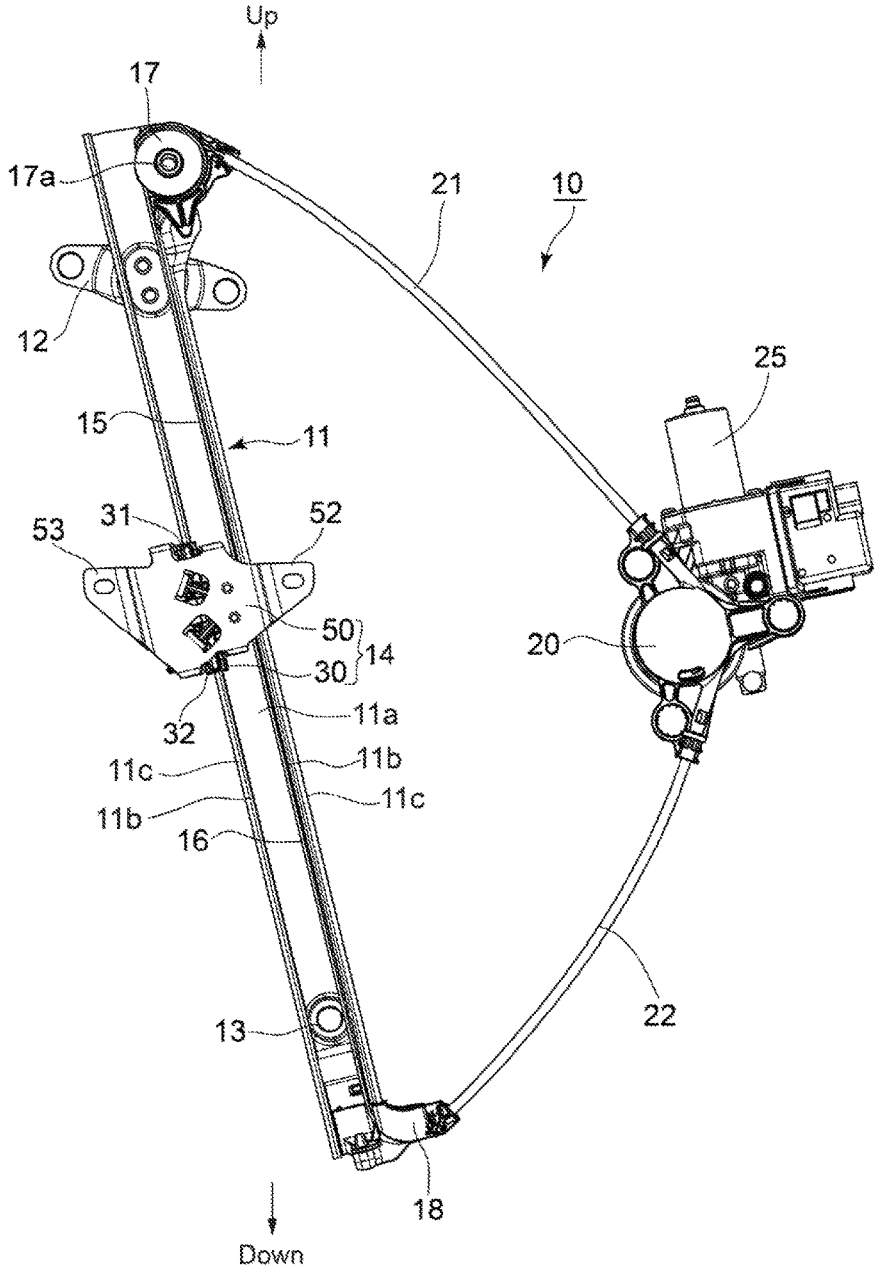
FIG. 2 is a rear elevational view of the window regulator.
Figure 3:
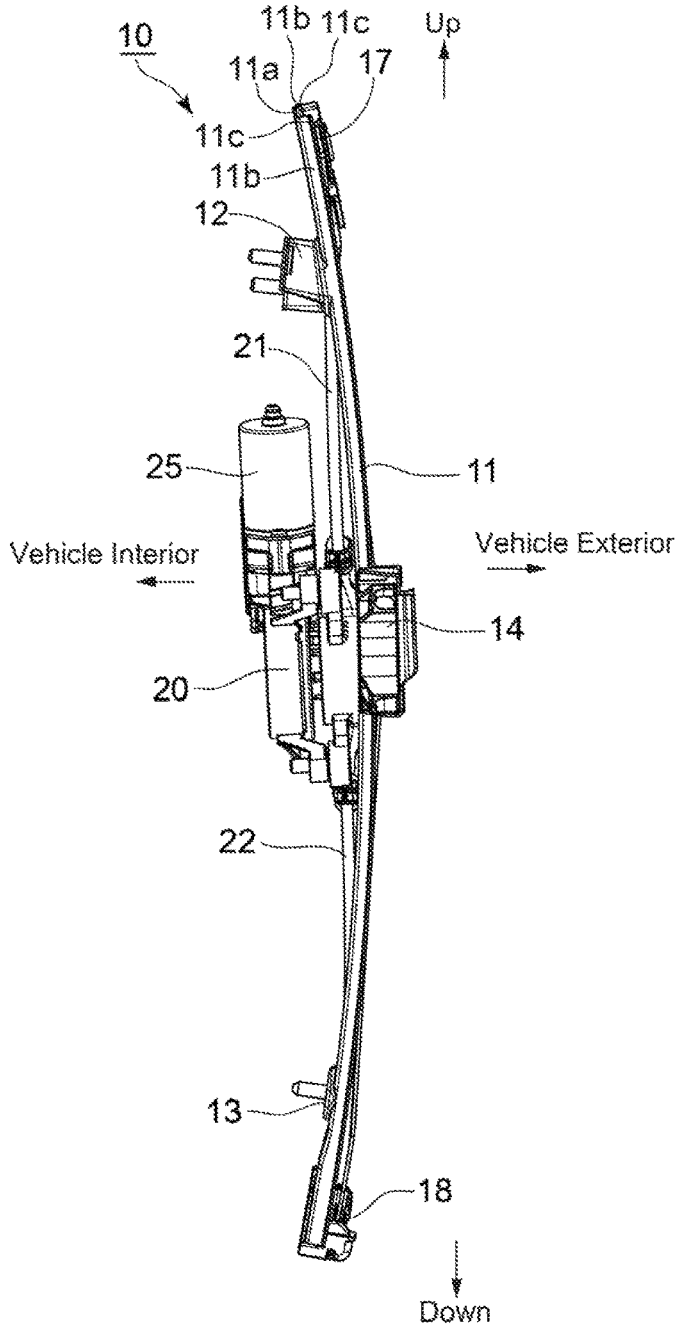
FIG. 3 is a side elevational view of the window regulator.

A window regulator 10 that is shown in FIGS. 1 through 3 is installed in a door panel (not shown) of a vehicle and moves a window glass (not shown) up and down. "Up" and "Down" shown by arrows in FIGS. 1 through 3 correspond to the vehicle upward and downward directions. Additionally, in FIG. 3, the directions toward the vehicle exterior side and the vehicle interior side with the window regulator 10 installed to the vehicle door panel are shown by arrows. The window regulator 10 is provided with a guide rail 11 that is made as a long member. The guide rail 11 is fixed to a door panel (inner panel) via brackets 12 and 13 provided at different positions in the longitudinal direction of the guide rail 11. In this fixed state, the guide rail 11 is positioned so that the longitudinal direction thereof extends substantially in the upward and downward directions. In the following descriptions, the widthwise direction refers to that of the guide rail 11 shown in FIGS. 1 and 2.

A slider base 14 which supports a window glass is supported by the guide rail 11 to be movable in the longitudinal direction thereof. One end of each of a pair of wires 15 and 16 (FIG. 2) is connected to the slider base 14. The wire 15 extends upward along the guide rail 11 from the slider base 14 and is guided by a guide pulley 17 provided in the vicinity of the upper end of the guide rail 11. The guide pulley 17 is rotatable about a shaft 17*a* and supports the wire 15 via a wire guide groove formed on the outer periphery of the guide pulley 17. The wire 16 extends downward along the guide rail 11 from the slider base 14 and is guided by a guide piece 18 provided in the vicinity of the lower end of the guide rail 11. The guide piece 18 is fixed to the guide rail 11 and supports the wire 16 in a manner to allow the wire 16 to advance and retreat along a wire guide groove formed on the guide piece 18.

The wires 15 and 16 that extend from the guide pulley 17 and the guide piece 18 are inserted into guide tubes 21 and 22, respectively, and wound around a winding drum that is provided inside a drum housing 20 to which the guide tubes 21 and 22 are connected. The drum housing 20 is fixed to the door panel (inner panel). The winding drum is driven to rotate by a motor 25. Forward and reverse rotations of the winding drum cause one of the wires 15 and 16 to increase the winding amount thereof around the winding drum and cause the other of the wires 15 and 16 to advance from the winding drum, thereby causing the slider base 14 to move along the guide rail 11 due to the pulling-loosening relationship between the pair of wires 15 and 16. In accordance with this movement of the slider base 14, the window glass moves up and down.

Figure 6:
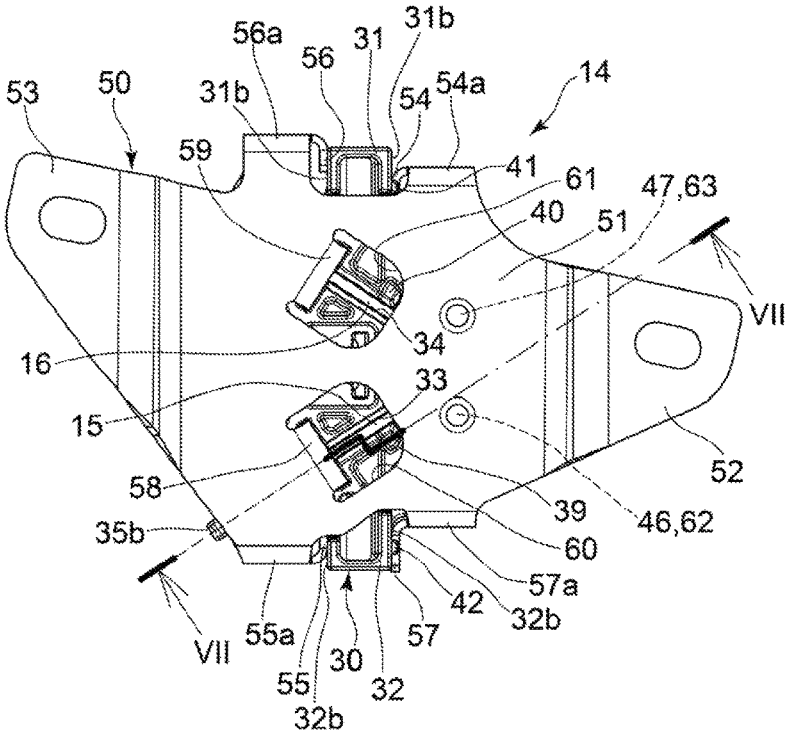
FIG. 6 is a rear elevational view of the slider base.
Figure 7:
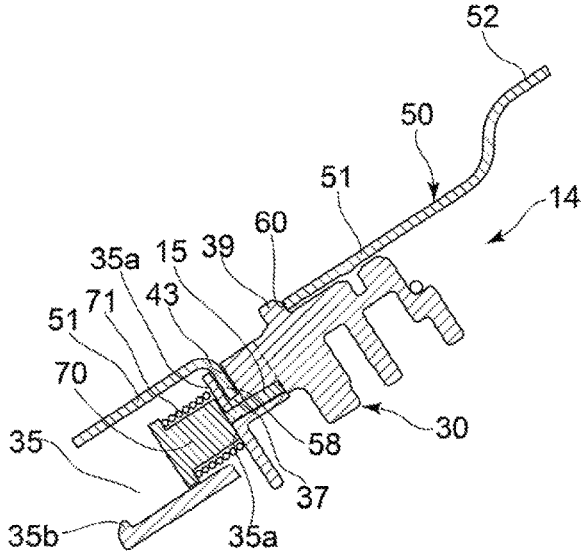
FIG. 7 is a sectional view taken along the line VII-VII shown in FIG. 6.
Figure 8:
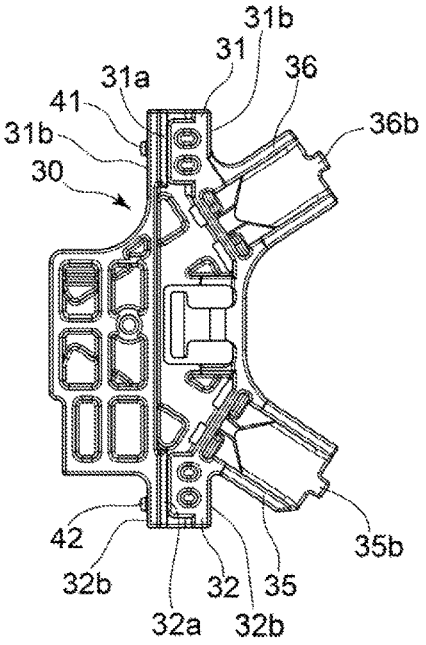
FIG. 8 is a front elevational view of a body member which constitutes an element of the slider base.
Figure 9:
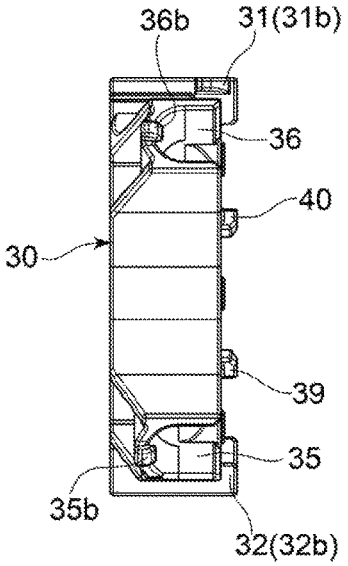
FIG. 9 is a side elevational view of the body member.
Figure 10:
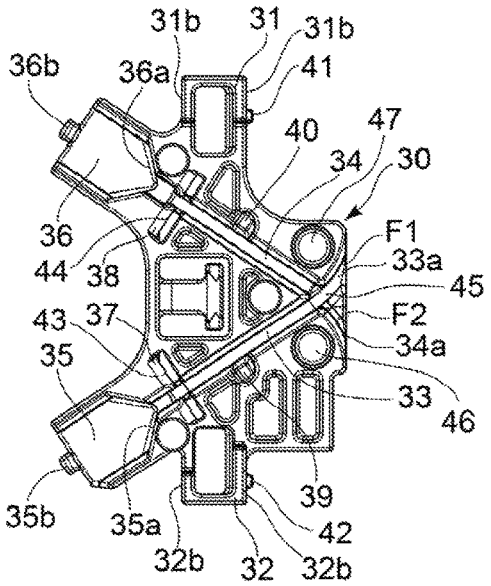
FIG. 10 is a rear elevational view of the body member.
Figure 11:
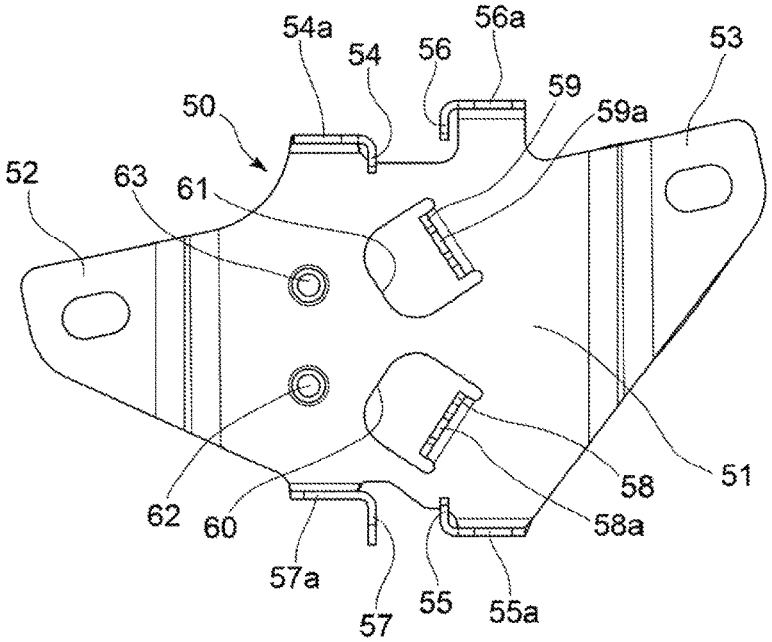
FIG. 11 is a front elevational view of a support plate which constitutes an element of the slider base.
Figure 12:
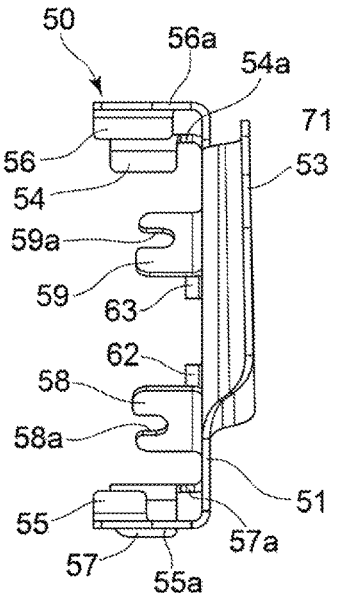
FIG. 12 is a side elevational view of the support plate.
Figure 13:
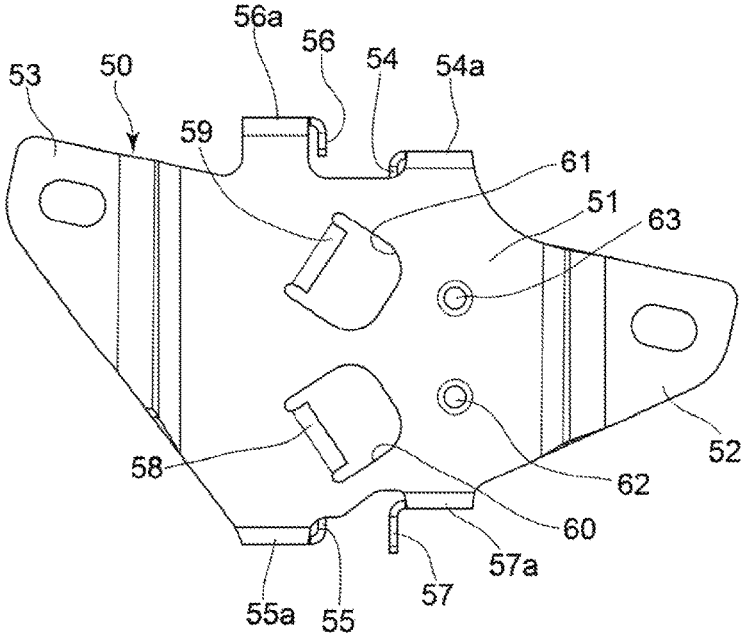
FIG. 13 is a rear elevational view of the support plate.

As shown in FIGS. 4 through 7, the slider base 14 is configured of a combination of a body member 30 made of synthetic resin and a support member 50 made of metal. FIGS. 8 through 10 show the body member 30 alone and FIGS. 11 through 13 show the support member 50 alone.

The body member 30 is provided, at different positions in the upward and downward directions (the longitudinal direction of the guide rail 11) with a pair of guide portions 31 and 32, and is supported by the guide rail 11 to be slidable relative to the guide rail 11. More specifically, the guide rail 11 is provided on either side thereof with a pair of side walls 11*b*, from each of which a flange 11*c* is projected laterally, thus having a hat-shaped cross section (see FIGS. 1 through 3), and the guide portions 31 and 32 are provided with grooves 31*a* and 32*a* (FIGS. 4 and 8), respectively, which are engaged with a side wall 11*b* and a flange 11*c* which are formed on one side of the guide rail 11. The body member 30 can move in the longitudinal direction of the guide rail 11 while making the inner surfaces of the grooves 31*a* and 32*a* slide against the side wall 11*b* and the flange 11*c* on the aforementioned one side of the guide rail 11. The guide portions 31 and 32 are prevented from moving in the widthwise direction of the guide rail 11.

Each of the guide portions 31 and 32 is formed into a projecting portion; the guide portion 31 is provided on either side thereof with a pair of side surfaces 31*b* substantially parallel to each other which are spaced from each other in the widthwise direction of the guide rail 11, and the guide portion 32 is provided on either side thereof with a pair of side surfaces 32*b* substantially parallel to each other which are spaced from each other in the widthwise direction of the guide rail 11. The side surfaces 31*b* and 32*b* are each formed into a surface extending in the longitudinal direction of the guide rail 11. A retaining projection 41 is projected from the side surface 31*b* formed on one side of the guide portion 31 and a retaining projection 42 is projected from the side surface 32*b* formed on one side of the guide portion 32.

The body member 30 is provided between the guide portion 31 and the guide portion 32 in the upward and downward directions with wire guide grooves 33 and 34 (FIG. 10). The wire guide grooves 33 and 34 are provided with wire lead-in openings 33*a* and 34*a* which open on one side of the body member 30, and the body member 30 is provided on the other side thereof with wire-end housing portions 35 and 36 (wire engaging portions). The wire guide groove 33 is a groove which communicatively connects the wire lead-in opening 33*a* and the wire-end housing portion 35. The wire lead-in opening 33*a* is positioned above the wire-end housing portion 35, and the wire guide groove 33 extends obliquely downward toward the wire-end housing portion 35 from the wire lead-in opening 33*a*. The wire guide groove 34 is a groove which communicatively connects the wire lead-in opening 34*a* and the wire-end housing portion 36. The wire lead-in opening 34*a* is positioned below the wire-end housing portion 36, and the wire guide groove 34 extends obliquely upward toward the wire-end housing portion 36 from the wire lead-in opening 34*a*. As the body member 30 is viewed in a plan view as shown in FIG. 10, the positional relationship between the wire guide groove 33 and the wire guide groove 34 is such that the wire guide groove 33 and the wire guide groove 34 intersect each other at an intersecting portion 45 in the vicinity of the wire lead-in openings 33*a* and 34*a*. At the intersecting portion 45, the wire guide groove 33 and the wire guide groove 34 are provided at different positions in the thickness direction of the body member 30.

The wire-end housing portions 35 and 36 are recessed portions which are greater in width than the wire guide grooves 33 and 34, respectively. The wire-end housing portion 35 lies on an extension of the wire guide groove 33 and projects obliquely downward from a side of the body member 30, while the wire-end housing portion 36 lies on an extension of the wire guide groove 34 and projects obliquely upward from a side of the body member 30. The wire-end housing portion 35 is provided, at the end thereof to which the wire guide groove 33 is connected, with a contact surface 35*a*. The end of the wire-end housing portion 35 on the opposite from the contact surface 35*a* is open, and the wire-end housing portion 35 is provided at this open end with a retaining projection 35*b* (wire retaining portion). Likewise, the wire-end housing portion 36 is provided, at the end thereof to which the wire guide groove 34 is connected, with a contact surface 36*a*. The end of the wire-end housing portion 36 on the opposite from the contact surface 36*a* is open, and the wire-end housing portion 36 is provided at this open end with a retaining projection 36*b* (wire retaining portion).

The wire guide grooves 33 and 34 and the wire end housing portions 35 and 36 are each open to a surface of the body member 30 on the vehicle exterior side (the side seen in FIG. 10). The body member 30 is further provided with plug-in grooves 37 and 38 which are recessed on surfaces of the body member 30 on the vehicle exterior side, and the body member 30 is further provided with projecting portions 39 and 40 which project from surfaces of the body member 30 on the vehicle exterior side surface. The projecting portion 39 is formed at a position adjacent to the wire guide groove 33, and the projecting portion 40 is formed at a position adjacent to the wire guide groove 34. The plug-in groove 37 is a groove which intersects the wire guide groove 33 and is positioned between the wire-end housing portion 35 and the projecting portion 39 in the direction of extension of the wire guide groove 33. A pressed surface 43 which faces in the same direction as the contact surface 35*a* is formed in the plug-in groove 37 (FIGS. 7 and 10). The plug-in groove 38 is a groove which intersects the wire guide groove 34 and is positioned between the wire-end housing portion 36 and the projecting portion 40 in the direction of extension of the wire guide groove 34. A pressed surface 44 which faces in the same direction as the contact surface 36*a* is formed in the plug-in groove 38 (FIG. 10). The wire-end housing portion 35 and the plug-in groove 37 each have a wider width than the groove width of the wire guide groove 33, and the projecting portion 39 is positioned within the range of the width of extensions of the wire-end housing portion 35 and the plug-in groove 37 in the direction along the wire guide groove 33. The wire-end housing portion 36 and the plug-in groove 38 each have a wider width than the groove width of the wire guide groove 34, and the projecting portion 40 is positioned within the range of the width of extensions of the wire-end housing portion 36 and the plug-in groove 38 in the direction along the wire guide groove 34.

The body member 30 is further provided below the intersecting portion 45 with a fitting hole 46 and provided above the intersecting portion 45 with a fitting hole 47. The fitting holes 46 and 47 are substantially circular bottomed holes which are recessed on surfaces of the body member 30 on the vehicle exterior side.

The support member 50 is provided with a cover portion 51 in the shape of a flat plate and provided at either side of the cover portion 51 with glass mounting portions 52 and 53. The glass mounting portions 52 and 53 are fixed to a window glass using fastening means not shown in the drawings. The cover portion 51 is provided with a pair of first holding lugs 54 and 55 and a pair of second holding lugs 56 and 57. The first holding lugs 54 and 55 are separately arranged at upper and lower end sides of the cover portion 51 and arranged at different positions in the widthwise direction of the cover portion 51. Likewise, the second holding lugs 56 and 57 are separately arranged at upper and lower end sides of the cover portion 51 and arranged at different positions in the widthwise direction of the cover portion 51. More specifically, the first holding lug 54 and the second holding lug 56 are formed at the upper end side of the cover portion 51 to be positioned to face each other in the widthwise direction of the cover portion 51. The first holding lug 55 and the second holding lug 57 are formed at the lower end side of the cover portion 51 to be positioned to face each other in the widthwise direction of the cover portion 51. In addition, the first holding lug 54 and the second holding lug 57 are provided at positions close to the glass mounting portion 52 in the widthwise direction of the cover portion 51, while the first holding lug 55 and the second holding lug 56 are provided at positions close to the glass mounting portion 53 in the widthwise direction of the cover portion 51. Accordingly, in a state where the support member 50 is viewed in a plan view as shown in FIGS. 11 and 13, a line which connects the first holding lugs 54 and 55 and a line which connects the second holding lugs 56 and 57 intersect each other. Each of the first holding lugs 54 and 55 and the second holding lugs 56 and 57 is formed as part of a bent portion which is bent toward the vehicle interior side with respect to the cover portion 51. The first holding lugs 54 and 55 and the second holding lug 56 are configured to bend toward the inside of the cover portion 51 (downward for the first holding lug 54 and the second holding lug 56 and upward for the first holding lug 55) at a substantially right angle relative to base-end bent portions 54*a*, 55*a* and 56*a* of the holding lugs 54, 55 and 56 that are bent at a substantially right angle relative to the cover portion 51. Whereas the second holding lug 57 is configured to bend toward the outside (toward the underside) of the cover portion 51 at a substantially right angle relative to a base-end bent portion 57*a* of the holding lug 57 that is bent at a substantially right angle relative to the cover portion 51.

The support member 50 is provided at different positions in the upward and downward directions with a pair of wire-end retaining lugs 58 and 59. As shown in FIG. 12, each of the wire-end retaining lugs 58 and 59 is formed by lancing (cutting and raising) a part of the cover portion 51 toward the vehicle interior side and is formed into a bifurcated projection provided at the end thereof with wire insertion grooves 58*a* and 59*a*. The cover portion 51 is provided with engaging holes 60 and 61 that are formed as a result of the aforementioned lancing operation that is performed when the wire-end retaining lugs 58 and 59 are formed. The engaging holes 60 and 61 are formed as holes which are inclined so as to reduce the distance therebetween in the upward and downward directions with respect to the direction toward the glass mounting portion 52 from the glass mounting portion 53 side in the widthwise direction of the support member 50. As shown in FIGS. 11 through 13, fitting projections 62 and 63 are formed in the vicinity of the engaging holes 60 and 61. The fitting projections 62 and 63 are cylindrical projections which project toward the vehicle interior side, similar to the wire-end retaining lugs 58 and 59.

Figure 5:
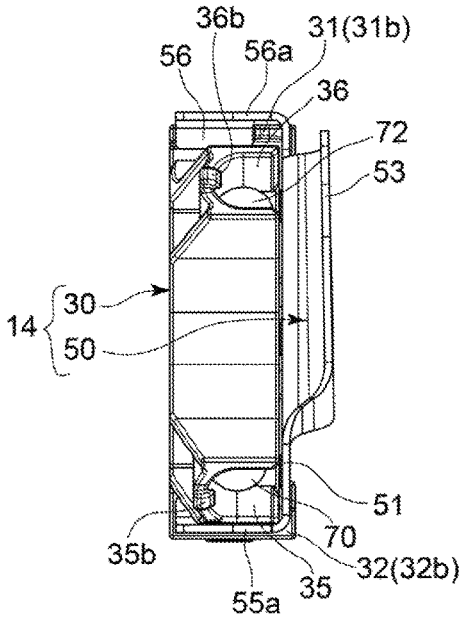
FIG. 5 is a side elevational view of the slider base.

Before the body member 30 and the support member 50 are combined, the wire 15 and the wire 16 are installed to the body member 30. As shown in FIG. 7, the wire 15 is provided at an end thereof with a wire end 70 which is greater in diameter than the wire 15. As described above, the wire guide groove 33 and the wire-end housing portion 35 are open to a surface of the body member 30 on the vehicle exterior side, and the wire 15 and the wire end 70 are inserted into the wire guide groove 33 and the wire-end housing portion 35, respectively, from the vehicle exterior side, to which the wire guide groove 33 and the wire-end housing portion 35 are open. As shown in FIG. 7, a compression spring 71 is inserted in between a flange portion of the wire end 70 inserted into the wire-end housing portion 35 and the contact surface 35*a*. The wire 16 is inserted into the wire guide groove 34 in the same manner as the wire 15. The wire 16 is provided at an end thereof with a large-diameter wire end 72 (part of which is shown in FIG. 5), and the wire end 72 is inserted into the wire-end housing portion 36. A compression spring (not shown) is inserted in between a flange of the wire end 72 and the contact surface 36*a*. The wire 15 and the wire 16 respectively inserted into the wire guide grooves 33 and 34 pass through the intersecting portion 45, at which the wire guide groove 33 and the wire guide groove 34 intersect each other, and are pulled out to the outside through the wire lead-in openings 33*a* and 34*a*, respectively. Since the wire guide groove 33 and the wire guide groove 34 are formed at different positions in the thickness direction of the body member 30 at the intersecting portion 45, the wire 15 and the wire 16 do not interfere with each other at the intersecting portion 45.

At the time of the installation of the wire 15 and the wire 16, the wire end 70 and the wire end 72 are not pressed against the contact surfaces 35*a* and 36*a* sides in the corresponding wire-end housing portions 35 and 36, respectively, in a state where no tension is applied to either of the wires 15 and 16. The retaining projection 35*b* and 36*b* prevent the wire ends 70 and 72 from coming off the wire end housing portions 35 and 36 in that state.

Figure 4:
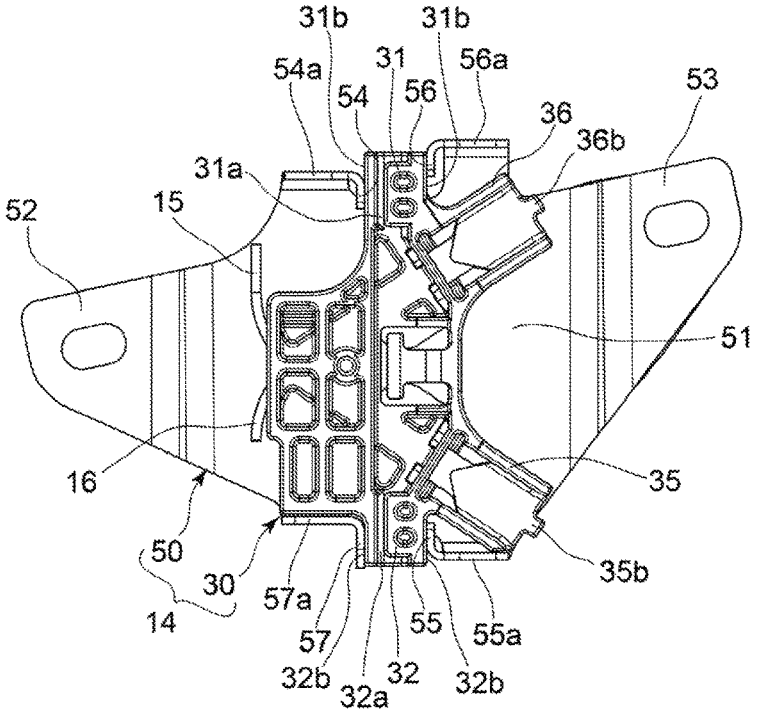
FIG. 4 is a front elevational view of a slider base which constitutes an element of the slider base.

The support member 50 is mounted to the body member 30 by placing the cover portion 51 on the body member 30 from the vehicle exterior side with the side of the support member 50 from which the first holding lugs 54 and 55, the second holding lugs 56 and 57, the wire-end retaining lugs 58 and 59 and the fitting projections 62 and 63 project facing toward the vehicle interior side. As shown in FIGS. 4 and 6, in a state where the support member 50 is mounted to the body member 30, both the side surfaces 31*b* of the guide portion 31 of the body member 30 are held by the first holding lug 54 and the second holding lug 56 that are provided on the support member 50, while both the side surfaces 32*b* of the guide portion 32 are held by the first holding lug 55 and the second holding lug 57. These holds prevent the body member 30 and the support member 50 from moving relative to each other in the widthwise direction. In addition, the holding of the upper and lower ends of the body member 30 by the base-end bent portions 54*a*, 55*a* and 56*a* prevents the body member 30 and the support member 50 from moving relative to each other in the upward and downward directions. At this time, as shown in FIG. 6, the retaining projection 41 and the retaining projection 42 of the body member 30 are engaged with the first holding lug 54 and the second holding lug 57 of the support member 50, respectively, so that the body member 30 and the support member 50 are connected so as not to be spaced apart from each other in the thickness direction of the slider base 14. More specifically, when the support member 50 is mounted to the body member 30, the first holding lug 54 comes into contact with the retaining projection 41, and thereupon the first holding lug 54 is resiliently deformed toward the glass mounting portion 52 side to ride over the retaining projection 41, while the second holding lug 57 comes into contact with the retaining projection 42, and thereupon the second holding lug 57 is resiliently deformed toward the glass mounting portion 52 side to ride over the retaining projection 42. Subsequently, upon the first holding lug 54 and the second holding lug 57 restoring from the resiliently deformed state after the first holding lug 54 and the second holding lug 57 respectively ride over the retaining projections 41 and 42, the body member 30 and the support member 50 come into the engaged state shown in FIG. 6.

Additionally, mounting the support member 50 to the body member 30 causes the wire-end retaining lug 58 to be inserted into the plug-in groove 37 and causes the wire-end retaining lug 59 to be inserted into the plug-in groove 38. The wire-end retaining lug 58 is inserted to lie on an extension of the wire 15 but does not interfere with the wire 15 by inserting the wire 15 into the wire insertion groove 58*a*. Likewise, the wire-end retaining lug 59 is inserted to lie on an extension of the wire 16 but does not interfere with the wire 16 by inserting the wire 16 into the wire insertion groove 59*a*. Additionally, mounting the support member 50 to the body member 30 causes the projecting portions 39 and 40 to be inserted into the engaging holes 60 and 61, respectively as shown in FIG. 6. The projecting portion 39 is in contact with a portion of the inner edge of the engaging hole 60 on the opposite side from the wire-end retaining lug 58. The projecting portion 40 is in contact with a portion of the inner edge of the engaging hole 61 on the opposite side from the wire-end retaining lug 59. Namely, the projecting portion 39 comes in contact with the inner edge of the engaging hole 60 in the direction identical to the direction in which an end of the wire end 70 (the end thereof to which the wire 15 is connected) comes in contact with the contact surface 35*a*, while the projecting portion 40 comes in contact with the inner edge of the engaging hole 61 in the direction identical to the direction in which an end of the wire end 72 (the end thereof to which the wire 16 is connected) comes in contact with the contact surface 36*a*. Additionally, in a state where the support member 50 is mounted to the body member 30, the fitting projection 62 and the fitting hole 46 are engaged with each other and the fitting projection 63 and the fitting hole 47 are engaged with each other.

The wire 15, the wire end 70 of which is connected at one end thereof to the slider base 14 that is made as described above, is extended upward along the guide rail 11, guided by the guide pulley 17 to be inserted into the guide tube 21 and wound around the winding drum provided in the drum housing 20. The wire 16, the wire end 72 of which is connected at one end thereof to the slider base 14, is extended downward along the guide rail 11, guided by the guide piece 18 to be inserted into the guide tube 22 and wound around the winding drum provided in the drum housing 20. The tension of each wire 15 and 16 increases as the winding amount of each wire 15 and 16 around the winding drum increases. As the tension of each wire 15 and 16 increases, the wire end 70 of the wire 15 (the end surface of the wire end 70 to which the wire 15 is connected) is pressed against the contact surface 35*a* of the wire-end housing portion 35 to thereby cause the compression spring 71, which is fitted on the wire end 70, to be compressed and deformed, and the wire end 72 of the wire 16 (the end surface of the wire end 72 to which the wire 16 is connected) is pressed against the contact surface 36*a* of the wire-end housing portion 36 to thereby cause the compression spring (not shown) which is fitted on the wire end 72 to be compressed and deformed. FIG. 7 shows a state where the wire end 70 is pressed against the contact surface 35*a*; likewise, the wire end 72 is pressed against the contact surface 36*a*.

FIGS. 1 through 3 show the completed state of the window regulator 10, in which the routing of the wires 15 and 16 is completed and the guide portions 31 and 32 of the slider base 14 are slidably supported on the guide rail 11. In this completed state, rotating the winding drum in the drum housing 20 causes one and the other of the wire 15 and the wire 16 to be pulled and loosened in accordance with the rotational direction of the winding drum. In the wire 15 or 16 which is pulled, the wire end 70 or 72 thereof transmits a force to the contact surface 35*a* or 36*a* of the associated wire-end housing portion 35 or 36. The wire ends 70 and 72 are prevented from moving relative to the slider base 14 toward the other end side of the wires 15 and 16 (toward the winding drum side) by contact with the contact surfaces 35*a* and 36*a*, and therefore, from the wire 15 or 16 which is pulled, a force to move the slider base 14 in the longitudinal direction of the guide rail 11 acts on a force application portion F1 or F2 (FIG. 10). The force application portion F1 is a portion on which an upward pulling force to pull the contact area of the slider base 14 with the wire 15 upward acts from the wire 15 when the wire 15 is pulled, and the force application portion F2 is a portion on which a downward pulling force to pull the contact area of the slider base 14 with the wire 16 downward acts from the wire 16 when the wire 16 is pulled. In the wire 15 or 16 which is loosened, the slack thereof is removed by the wire end 70 or 72 being pressed in a direction away from the contact surface 35*a* or 36*a* by the force of the compression spring 71, which acts on the wire end 70, or the compression spring (not shown) which acts on the wire end 72.

Figure 14:
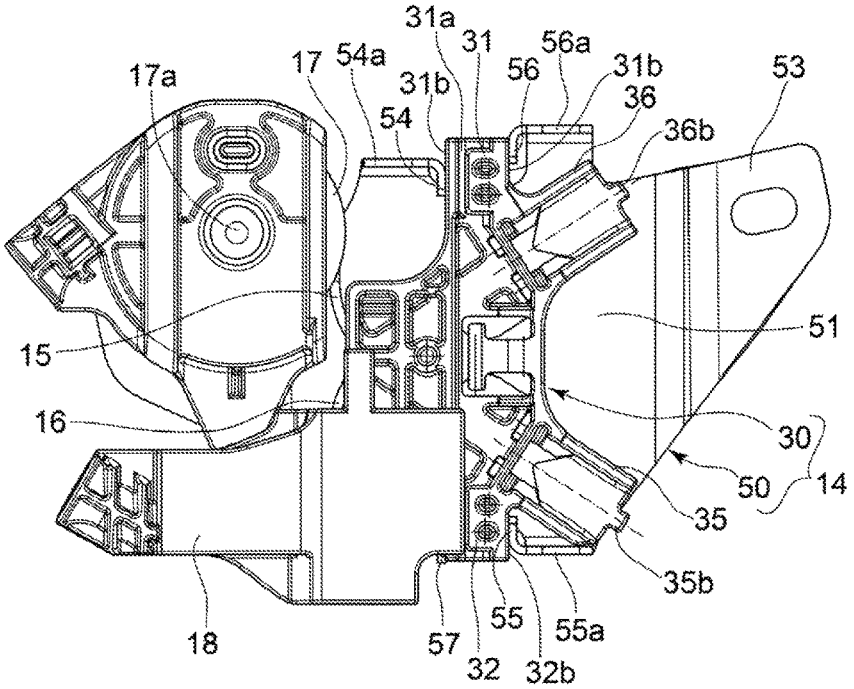
FIG. 14 is a front elevational view illustrating the relationship between the slider base and a guide pulley when the window glass is at the upper dead end and the relationship between the slider base and a guide piece when the window glass is at the lower dead end.
Figure 15:
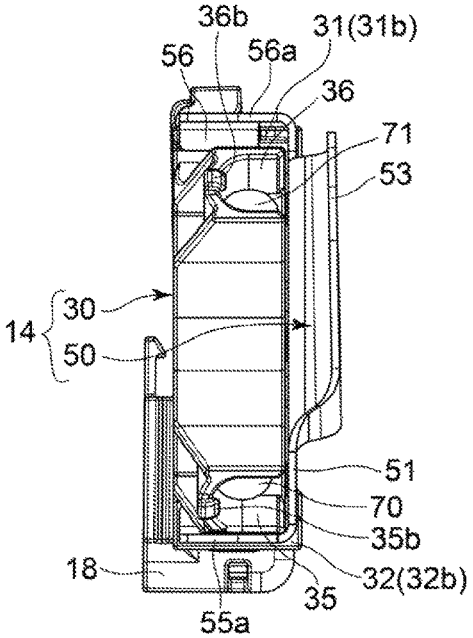
FIG. 15 is a side elevational view of the same.
Figure 16:
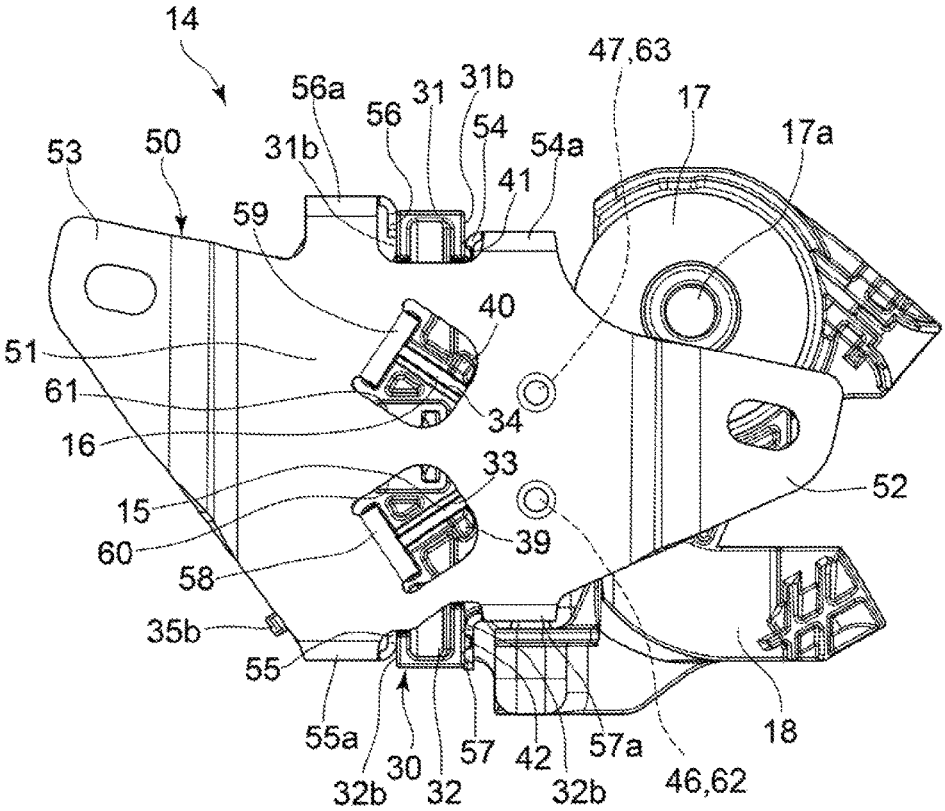
FIG. 16 is a rear elevational view of the same.

FIGS. 14 through 16 collectively show the relationship between the slider base 14 and the guide pulley 17 when the window glass is positioned at the upper dead point and the relationship between the slider base 14 and the guide piece 18 when the window glass is positioned at the lower dead point. As can be seen from these drawings, the guide portion 31 and the guide portion 32 on the slider base 14 are arranged at positions different from the positions of the guide pulley 17 and the guide piece 18 in the widthwise direction of the guide rail 11; accordingly, the slider base 14 can move up to a position lateral to the guide pulley 17 with no interference when the window glass is at the upper dead point, while the slider base 14 can move down to a position lateral to the guide piece 18 with no interference when the window glass is at the lower dead point. Namely, nearly the entire arrange of the guide rail 11 in the longitudinal direction corresponds to the range of movement of the slider base 14, which makes it possible to increase the amount of movement of the window glass (the stroke of the slider base 14) though the window regulator 10 is small in size.

In the window regulator 10 that is made as described above, when the slider base 14 is moved in the longitudinal direction of the guide rail 11 by pulling each wire 15 and 16, turning moment about one of the force application portions F1 and F2 which receives the pulling force acts on the slider base 14. The guide portions 31 and 32 are positioned between the force application portions F1 and F2 and the wire-end housing portions 35 and 36 in the widthwise direction of the guide rail 11. Therefore, it is possible to reduce the distance between the force application portions F1 and F2 and the guide portions 31 and 32 in the widthwise direction with no influence of the arrangement space for the wire-end housing portions 35 and 36 and the wire ends 70 and 72, thus making it possible to reduce the moment. Reducing the moment acting on the slider base 14 causes friction of the guide portions 31 and 32 against the guide rail 11 to decrease, thus making it possible to improve the operating efficiency in raising and lowering the window glass.

Additionally, in the slider base 14, the force application portions F1 and F2 and the wire-end housing portions 35 and 36 (specifically the contact surfaces 35*a* and 36*a*) are positioned between the guide portion 31 and the guide portion 32 in the upward and downward directions. According to this arrangement, the rotation of the slider base 14 relative to the slider base 14 can be suppressed by the guide portion 31 and the guide portion 32 that are great in distance therebetween in the upward and downward direction, and the slider base 14 can be made compact in size in the upward and downward directions by concentrating the support and connect structure for the wires 15 and 16 to the slider base 14 (the force application portions F1 and F2, which receive force in the raising and lowering directions from the wires 15 and 16, and the contact surfaces 35*a* and 36*a* of the wire-end housing portions 35 and 36, with which the wire ends 70 and 72 are engaged) in the vertical range between the guide portion 31 and the guide portion 32.

Additionally, in the slider base 14 of the window regulator 10, the support member 50 that is made of metal is fixed to the window glass, and the body member 30 that is made of synthetic resin is indirectly connected to the window glass via the support member 50, without being directly fixed to the window glass. Accordingly, the force acting on the window glass is received by the support member 50 that is high in rigidity, which makes it possible to prevent the concentration of stress on the body member 30. Since the body member 30 is a portion which takes charge of sliding on the guide rail 11 and connection of the wires 15 and 16, the performance of the window regulator 10 can be maintained by preventing the body member 30 from being warped or deformed by the concentration of stress on the body member 30. Specifically, by holding the guide portions 31 and 32 of the body member 30 in the widthwise direction with the pair of first holding lugs 54 and 55 and the pair of second holding lugs 56 and 57 that are provided on the support member 50, the rotational rigidity of the slider base 14 relative to the inclination of the window glass in the leftward and rightward directions with respect to FIGS. 1 and 2 (the forward and backward directions of the vehicle in the case where the window regulator 10 is mounted to a vehicle side door) can be enhanced.

For instance, when a force tending to rotate the support member 50 in the clockwise direction with respect to FIG. 1 (the counterclockwise direction with respect to FIG. 2) acts on the support member 50 from the window glass, a pressing force is exerted on the guide portions 31 and 32 from the first holding lugs 54 and 55 that are positioned diagonally with the guide portions 31 and 32 positioned between the first holding lugs 54 and 55. Conversely, when a force tending to rotate the support member 50 in the counterclockwise direction with respect to FIG. 1 (the clockwise direction with respect to FIG. 2) acts on the support member 50 from the window glass, a pressing force is exerted on the guide portions 31 and 32 from the second holding lugs 56 and 57 that are positioned diagonally with the guide portions 31 and 32 positioned between the second holding lugs 56 and 57. Since the guide portions 31 and 32 are provided at positions spaced from each other in the upward and downward directions (at the upper and lower ends of the slider base 14), the body member 30 is not easily locally warped or deformed upon receiving such a pressing force, so that it is possible to prevent an adverse effect from being exerted on the performance of the slider base 14. Additionally, since the side wall 11*b* and the flange 11*c* of the guide rail 11 are engaged in the groove portions 31*a* and 32*a* of the guide portions 31 and 32 in a state where the slider base 14 is supported by the guide rail 11, the guide rail 11 functions as a reinforcing member for the guide portions 31 and 32 to achieve high rigidity when a pressing force acts on the guide portions 31 and 32 from the first holding lugs 54 and 55 and the second holding lugs 56 and 57.

The guide portions 31 and 32 of the body member 30 are slidably engaged with the guide rail 11 and held by the first holding lugs 54 and 55 and the second holding lugs 56 and 57. In addition, the retaining projections 41 and 42, which are provided on the guide portions 31 and 32 of the body member 30, function as retaining portions which prevent the body member 30 and the support member 50 from moving away from each other in the thickness direction of the slider base 14 by engagement with the first holding lug 54 and the second holding lug 57 of the support member 50. Since multiple functions are given to the guide portions 31 and 32 and each holding lug 54, 55, 56 and 57 as just described, simplification of the structure of the slider base 14 has been achieved.

As shown in FIGS. 14 and 16, the base-end bent portion 54*a* of the first holding lug 54 is different in position in the widthwise direction from the guide pulley 17, and the base-end bent portion 54*a* and the guide pulley 17 do not interfere with each other when the slider base 14 is moved up to the upper dead point of the window glass. On the other hand, the base-end bent portion 57*a* of the second holding lug 57 is located at a position overlapping the guide piece 18 in the widthwise direction. Hence, the second holding lug 57 is projected from the base-end bent portion 57*a* in the direction opposite to the direction in which the first holding lug 55 bends, i.e., in a direction away from the cover portion 51 (in the downward direction) with respect to the direction toward the end of the base-end bent portion 57*a*. With this configuration, the position of the base-end bent portion 57*a* is set above the base-end bent portion 55*a* to allow the downward stroke of the slider base 14 to increase without the base-end bent portion 57*a* and the guide piece 18 interfering with each other.

The present embodiment of the window regulator 10 is provided with the two pairs of holding lugs: the first holding lugs 54 and 55 and the second holding lugs 56 and 57. This structure is desirable because the rotational rigidity can be enhanced also with respect to the inclination of the window glass in any direction; however, it is possible that the window regulator 10 be provided with only one pair of holding lugs. For instance, in the case where it is required mainly to improve the rotational rigidity of the slider base 14 against rotation of the window glass in the clockwise direction with respect to FIG. 1 (the counterclockwise direction with respect to FIG. 2), the second holding lugs 56 and 57 can be omitted, i.e., only the first holding lugs 54 and 55 can be provided.

Pulling each wire 15 and 16 by rotating the winding drum in the raising and lowering operation of the window glass in the window regulator 10 causes tensile force to act on the corresponding contact surface 35*a* or 36*a* from the wire end 70 or 72 of the wire 15 or 16 which is pulled. For instance, the tensile force which acts on the contact surface 35*a* from the wire end 70 acts on the body member 30, on which the contact surface 35*a* is formed, as a load in a direction toward the other end of the wire 15 along the wire guide groove 33. More specifically, the load imposed on the contact surface 35*a* of the body member 30 is received by the wire-end retaining lug 58 of the support member 50, which causes the wire-end retaining lug 58 to press the presses surface 43, thus causing the load to act on the body member 30. As shown in FIGS. 6 and 7, the projecting portion 39 is provided in the direction of action of this load, and the projecting portion 39 is pressed against the inner edge of the engaging hole 60 upon receiving the load on the body member 30. Thereupon, a compression load to the body member 30 acts between the contact area between the wire-end retaining lug 58 and the pressed surface 43 and the contact area between the projecting portion 39 and the inner edge of the engaging hole 60. Likewise, the tensile force which acts on the contact surface 36*a* from the wire end 72 acts on the body member 30 as a load in a direction toward the other end of the wire 16 along the wire guide groove 34. More specifically, the load imposed on the contact surface 36*a* of the body member 30 is received by the wire-end retaining lug 59 of the support member 50, which causes the wire-end retaining lug 59 to press the presses surface 44, thus causing the load to act on the body member 30. As shown in FIG. 6, the projecting portion 40 is provided in the direction of action of this load, and the projecting portion 40 is pressed against the inner edge of the engaging hole 61 upon receiving the load on the body member 30. Thereupon, a compression load to the body member 30 acts between the contact area between the wire-end retaining lug 59 and the pressed surface 44 and the contact area between the projecting portion 40 and the inner edge of the engaging hole 61. The body member 30 that is made of synthetic resin is superior in load bearing against the compression load compared with tensile load and shearing load, thus having the advantage of not being easily damaged or deformed even when a strong load is exerted on the body member 30.

The body member 30 and the support member 50 are further provided, at upper and lower positions on the vertically opposite sides of the intersecting portion 45, with a fitting portion consisting of the fitting hole 46 and the fitting projection 62 and a fitting portion consisting of the fitting hole 47 and the fitting projection 63. Engaging the body member 30 and the support member 50 with each other at upper and lower positions on the vertically opposite sides of the intersecting portion 45 in this manner makes it possible to disperse stress applied to the body member 30 when the wires 15 and 16, which are routed through the wire lead-in opening 33*a* of the wire guide groove 33 and the wire lead-in opening 34*a* of the wire guide groove 34, are pulled in the upward and downward directions (when the wire 15 is pulled in the upward direction and the wire 16 is pulled in the downward direction). This configuration further improves the load bearing of the slider base 14.

The projecting portions 39 and 40 are projections which are projected from a surface of the body member 30 which faces toward the vehicle exterior side and can be easily formed in molding the body member 30. In the body member 30, in particular, the wire guide grooves 33 and 34, the wire-end housing portions 35 and 36, the projecting portions 39 and 40 and the fitting holes 46 and 47 are all provided on a surface of the body member 30 which faces the vehicle exterior side as can be seen from FIG. 10, so that these portions can be simultaneously formed using a mold which can be released toward the vehicle exterior side. In addition, the engaging holes 60 and 61 can be simultaneously formed when the support member 50 are lanced to form the wire-end retaining lugs 58 and 59. Accordingly, the projecting portions 39 and 40 and the engaging holes 60 and 61 each have a configuration superior in productivity.

It is also possible to adopt a configuration in which pits corresponding to the engaging holes 60 and 61 and projections corresponding to the projecting portions 39 and 40 are formed on the body member 30 side and the support member 50 side, respectively; namely, the pit-and-projection relationship can be reversed compared with that in the above described embodiment. Likewise, it is also possible to adopt a configuration in which projections corresponding to the fitting projections 62 and 63 are formed on the body member 30 side and pits corresponding to the fitting holes 46 and 47 are formed on the support member 50 side.

As described above, the body member 30 and the support member 50 are provided with the plug-in grooves 37 and 38 and the wire-end retaining lugs 58 and 59 in addition to engaging portions consisting of the projecting portions 39 and 40 and the engaging holes 60 and 61. The plug-in groove 37 and the wire-end retaining lug 58 are positioned closer to the wire-end housing portion 35 than the projecting portion 39 and the engaging hole 60, while the plug-in groove 38 and the wire-end retaining lug 59 are positioned closer to the wire-end housing portion 36 than the projecting portion 40 and the engaging hole 61. The tensile force applied to the contact surface 35*a* from the wire end 70 is received by the wire-end retaining lug 58 that is positioned in the plug-in groove 37, the tensile force applied to the contact surface 36*a* from the wire end 72 is received by the wire-end retaining lug 59 that is positioned in the plug-in groove 38, and the stress on the body member 30 from the wire ends 70 and 72 can be dispersed to the support member 50 via the wire-end retaining lugs 58 and 59 together with the engaging portions consisting of the projecting portions 39 and 40 and the engaging holes 60 and 61. Each of the wire-end retaining lugs 58 and 59 when the slider base 14 is viewed in a plan view as shown in FIG. 6 is greater in width than the contact areas of the wire ends 70 and 72 with the contact surfaces 35*a* and 36*a*, which is high in stress-dispersing effect. In addition, portions of the body member 30 between the pressed surface 43 and the projecting portion 39 and between the pressed surface 44 and the projecting portion 40 each take the form of a strut against compression load, thus being capable of obtaining the effect of preventing the wire-end retaining lugs 58 and 59, each of which projects in the form of a cantilever from the support member 50, from being deformed. Hence, the relationship to mutually increase the strength between the body member 30 and the support member 50 is established.

As can be understood from FIGS. 4, 6 and 10, the projecting portion 39 is positioned within the range of the width of extensions of the wire-end housing portion 35 and the wire-end retaining lug 58 toward the other end of the wire 15 along the wire guide groove 33. Likewise, the projecting portion 40 is positioned within the range of the width of extensions of the wire-end housing portion 36 and the wire-end retaining lug 59 toward the other end of the wire 16 along the wire guide groove 34. Namely, the contact area between the projecting portion 39 and the engaging hole 60 entirely lies on an extension of the direction of action of the load applied to the body member 30 from the wire end 70, while the contact area between the projecting portion 40 and the engaging hole 61 entirely lies on an extension of the direction of action of the load applied to the body member 30 from the wire end 72. According to this arrangement, the aforementioned stress dispersion effect that is obtained through the projecting portions 39 and 40 and the engaging holes 60 and 61 can be enhanced.

However, unlike the present embodiment, even in the case of an arrangement in which part of the contact area between the projecting portion 39 and the engaging hole 60 is positioned outside the range of the width of the extensions of the wire-end housing portion 35 and the wire-end retaining lug 58 or an arrangement in which part of the contact area between the projecting portion 40 and the engaging hole 61 is positioned outside the range of the width of the extensions of the wire-end housing portion 36 and the wire-end retaining lug 59, a certain effect for improvement of the load bearing of the slider base 14 can be obtained.

Figure 17:
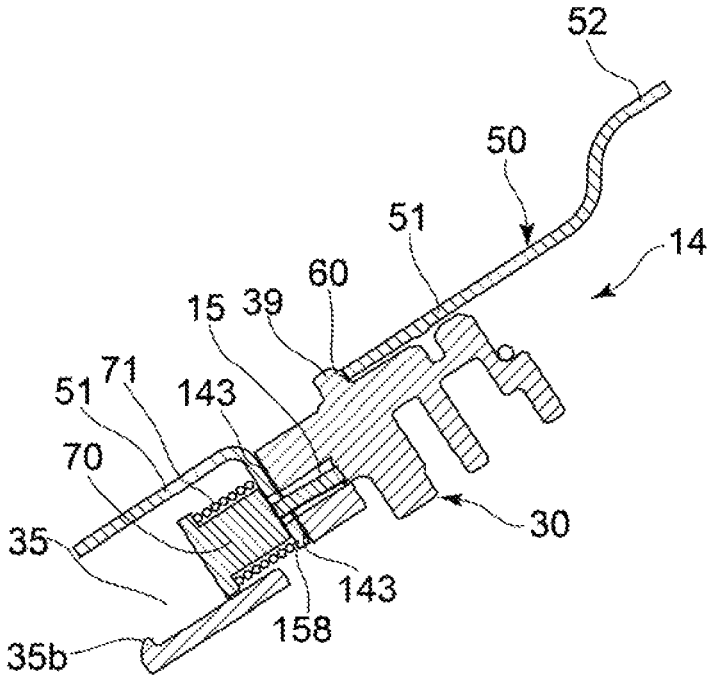
FIG. 17 is a sectional view, similar to that of FIG. 7, illustrating a different embodiment of the slider base.

FIG. 17 shows a different embodiment of the slider base 14. In this embodiment, the end surface of the wire end 70 to which the wire 15 is connected is made into contact with the support member 50, not with the body member 30. More specifically, a wire-end retaining lug 158 is formed on the support member 50 by lancing the support member 50, and pulling the wire 15 causes the end surface of the wire end 70 to come into contact with the wire-end retaining lug 158. A pressed surface 143 (pressed portion) with which the surface of the wire-end retaining lug 158 on the opposite side from the surface thereof which contacts the wire end 70 is formed on the body member 30, so that the load applied to the wire-end retaining lug 158 from the wire end 70 also acts on the pressed surface 143. As with the previous embodiment, the projecting portion 39 comes in contact with the inner edge of the engaging hole 60 at a forward point in the direction of action of the aforementioned load, and a compression load to the body member 30 acts between the contact area between the wire-end retaining lug 158 and the pressed surface 143 and the projecting portion 39 and the inner edge of the engaging hole 60. With this configuration, an effect similar to that of the previous embodiment is obtained. Although not shown in the drawings, a similar load receiving structure is also provided for the other wire 16.

Although the present invention has been described based on the above illustrated embodiment, the present invention is not limited thereto; improvements and modifications may be made without departing from the gist of the invention.

For instance, in the above illustrated embodiment, the guide portions 31 and 32 are positioned between the two wire-end housing portions 35 and 36 and the two force application portions F1 and F2 in the widthwise direction of the guide rail 11. This arrangement makes it possible to obtain the effect of suppressing the turning moment of the slider base 14 also in the driving of the window glass in either the raising or lowering direction; however, a configuration which makes the guide portions 31 and 32 positioned only in one of the areas between the wire-end housing portion 35 and the force application portion F1 and between the wire-end housing portion 36 and the force application portion F2 is also possible as a modified embodiment. In this configuration, the effect of suppressing the turning moment of the slider base 14 in the operation of the window glass in either the raising or lowering direction is obtained.

Although the slide base 14 is provided at different positions in the upward and downward directions with the two guide portions 31 and 32 in the above illustrated embodiment, the number of the guide portions is not limited to this particular number; it is also possible to provide one or more than two guide portions.

INDUSTRIAL APPLICABILITY

As described above in detail, a window regulator according to the present invention is such that a slider base, which supports a window glass and is supported on a guide rail to be slidable in the longitudinal direction thereof, includes: a guide portion the movement of which with respect to the guide rail in the widthwise direction thereof is restricted and which is fitted to the guide rail to be movable in the longitudinal direction thereof; first and second wire engaging portions with which ends of the wires are engaged; and first and second force application portions which receive a force to move the first and second force application portions in the pulling direction following contact of the wires with the first and second force application portions when the wires are pulled in the longitudinal direction of the guide rail, wherein the guide portion is positioned in at least one of the areas between the first force application portion and the first wire engaging portion and between the second force application portion and the second wire engaging portion in the widthwise direction of the guide rail. This configuration makes it possible to provide a high-quality window regulator which is superior in smoothness of operation and operating efficiency when the slider base is driven.

REFERENCE SIGNS LIST

10 Window regulator
11 Guide rail
11*a* Plate portion
11*b* Side wall
11*c* Flange
12 13 bracket
14 Slider base
15 16 Wire
17 Guide piece
17*a* Shaft
18 Guide piece
20 Drum housing
21 22 Guide tube
25 Motor
30 Body member
31 32 Guide portion
31*a* 32*a* Groove portion
31*b* 32*b* Side surface
33 34 Wire guide groove
33*a* 34*a* Wire lead-in opening
35 36 Wire-end housing portion (Wire engaging portion)
35*a* 36*a* Contact surface
35*b* 36*b* Retaining projection (Wire retaining portion)
37 38 Plug-in groove
39 40 Projecting portion
41 42 Retaining projection
43 44 143 Pressed surface
45 Intersecting portion
46 47 Fitting hole
50 Support member
51 Cover portion
52 53 Glass mounting portion
54 55 First holding lug
54*a* 55*a* Base-end bent portion
56 57 Second holding lug
56*a* 57*a* Base-end bent portion
58 59 158 Wire-end retaining lug
58*a* 59*a* Wire insertion groove
60 61 Engaging hole
62 63 Fitting projection
70 72 Wire end
F1 F2 Force application portion

The invention claimed is:

1. A window regulator including:

a guide rail which is fixed to a vehicle;

a slider base which supports a window glass and is supported on said guide rail to be slidable in a longitudinal direction of said guide rail; and a pair of wires which are routed along said longitudinal direction of said guide rail and connected to said slider base, wherein said slider base comprises: a guide portion movement of which with respect to said guide rail in a widthwise direction of said guide rail is restricted and which is fitted to said guide rail to be movable along a longitudinal axis which extends in said longitudinal direction of said guide rail; first and second wire engaging portions with which ends of said wires are engaged, respectively; and first and second force application portions which receive a force to move said slider base in a pulling direction following contact of said wires with said first and second force application portions when said wires are pulled in said longitudinal direction of said guide rail, and wherein said first force application portion and said first wire engaging portion are positioned on opposite sides of said longitudinal axis such that said guide portion is positioned in between said first force application portion and said first wire engaging portion in said widthwise direction of said guide rail.

2. The window regulator according to claim 1, wherein said second force application portion and said second wire engaging portion are positioned on opposite sides of said longitudinal axis such that said guide portion is positioned in between said second force application portion and said second wire engaging portion in said widthwise direction of said guide rail.

3. The window regulator according to claim 1, wherein said guide portion of said slider base comprises a plurality of guide portions arranged at different positions in said longitudinal direction of said guide rail, and wherein said first wire engaging portion and said second wire engaging portion are positioned between said plurality of guide portions in said longitudinal direction of said guide rail.

4. The window regulator according to claim 3, wherein said first force application portion and said second force application portion are positioned between said plurality of guide portions in said longitudinal direction of said guide rail.

5. The window regulator according to claim 1, wherein said slider base comprises a wire retaining portion which prevents said ends of said wires from being disengaged from the first wire engaging portion and said second wire engaging portion.

* * * * *